US008075710B2

(12) United States Patent
Skårman et al.

(10) Patent No.: US 8,075,710 B2
(45) Date of Patent: Dec. 13, 2011

(54) SOFT MAGNETIC COMPOSITE MATERIALS

(75) Inventors: Björn Skårman, Höganäs (SE); Zhou Ye, Lerbergetus (SE); Patricia Jansson, Viken (SE)

(73) Assignee: Höganäs AB, Höganäs (SE)

( * ) Notice: Subject to any disclaimer, the term of this patent is extended or adjusted under 35 U.S.C. 154(b) by 707 days.

(21) Appl. No.: 11/921,514

(22) PCT Filed: Jun. 15, 2006

(86) PCT No.: PCT/SE2006/000722

§ 371 (c)(1),
(2), (4) Date: Dec. 4, 2007

(87) PCT Pub. No.: WO2006/135324

PCT Pub. Date: Dec. 21, 2006

(65) Prior Publication Data

US 2009/0042051 A1 Feb. 12, 2009
US 2011/0129685 A2 Jun. 2, 2011

Related U.S. Application Data

(60) Provisional application No. 60/702,996, filed on Jul. 28, 2005.

(30) Foreign Application Priority Data

Jun. 15, 2005 (SE) ..... 0501378

(51) Int. Cl.
*H01F 1/24* (2006.01)

(52) U.S. Cl. ..... 148/306; 148/104; 148/122

(58) Field of Classification Search ..... None
See application file for complete search history.

(56) References Cited

U.S. PATENT DOCUMENTS 5,770,136 A * 6/1998 Huang ..... 264/101
6,348,265 B1 2/2002 Jansson et al.
(Continued)

FOREIGN PATENT DOCUMENTS

CN 1211943 A 3/1999
(Continued)

OTHER PUBLICATIONS

Decision on Grant issued by Federal Service on Industrial Property, Patents and Trade Marks for Application No. 2008101535, Nov. 9, 2009, Moscow, Russia.

(Continued)

*Primary Examiner* — John Sheehan
(74) *Attorney, Agent, or Firm* — Buchanan Ingersoll & Rooney PC

(57) ABSTRACT

A process for the manufacture of soft magnetic composite components is provided including the steps of: die compacting a powder composition including a mixture of soft magnetic, iron or iron-based powder, core particles of which are surrounded by an electrically insulating, inorganic coating, and an organic lubricant in an amount of 0.05 to 1.5% by weight of the composition, the organic lubricant being free from metal and having a temperature of vaporization less than the decomposition temperature of the coating; ejecting the compacted body from the die; heating the compacted body in an inert atmosphere to a temperature above the vaporization temperature of the lubricant and below the decomposition temperature of the inorganic coating for removing the lubricant from the compacted body, and subjecting the body obtained after heating the compacted body in an inert atmosphere to heat treatment at a temperature between 300 and 600 in water vapor.

20 Claims, 2 Drawing Sheets

U.S. PATENT DOCUMENTS

| | | | | |
|---|---|---|---|---|
| 6,419,877 | B1 | 7/2002 | Elgelid et al. | |
| 6,485,579 | B1 | 11/2002 | Nillius et al. | |
| 6,562,458 | B2 | 5/2003 | Elgelid et al. | |
| 6,706,206 | B1 | 3/2004 | Aichele et al. | |
| 6,861,028 | B2 | 3/2005 | Ozaki et al. | |
| 2004/0007291 | A1* | 1/2004 | Wood et al. | 148/122 |
| 2004/0126609 | A1 | 7/2004 | Ueta et al. | |
| 2004/0191519 | A1* | 9/2004 | Kejzelman et al. | 428/407 |
| 2005/0162034 | A1 | 7/2005 | Soghomonian | |

FOREIGN PATENT DOCUMENTS

| | | | |
|---|---|---|---|
| CN | 1322366 | A | 11/2001 |
| JP | 51-43007 | A | 11/1973 |
| JP | 54-150307 | A | 11/1979 |
| JP | 57 114637 | A | 7/1982 |
| JP | 07-166202 | A | 6/1995 |
| JP | 07-245209 | A | 9/1995 |
| JP | 2000-178603 | A | 6/2000 |
| JP | 2001-510286 | T | 7/2001 |
| JP | 2001-342478 | A | 12/2001 |
| JP | 2003-515661 | T | 5/2003 |
| RU | 2040810 | C1 | 7/1995 |
| SU | 863178 | A | 9/1981 |
| SU | 1734946 | A1 | 5/1992 |
| WO | WO9730810 | A1 | 8/1997 |
| WO | WO 99/03622 | A1 | 1/1999 |
| WO | WO 01/40416 | A1 | 6/2001 |
| WO | WO 2004/037468 | A1 | 5/2004 |
| WO | WO2004/038740 | A1 | 5/2004 |

OTHER PUBLICATIONS

English Translation of Decision on Grant issued by Federal Service on Industrial Property, Patents and Trade Marks for Application No. 2008101535, Nov. 9, 2009, Moscow, Russia.

English-language translation of JPO Office Action mailed on Nov. 9, 2010, in corresponding Japanese Patent Application No. JP 2008-516788.

* cited by examiner

SOFT MAGNETIC COMPOSITE MATERIALS

This is a filing under 35 U.S.C. §371 of International Application No. PCT/SE2006/000722, filed Jun. 15, 2006 that designates the United States of America, and the benefit is claimed under 35 U.S.C. §119(a)-(d) of Swedish Application No. 0501378-4 filed Jun. 15, 2005 and under 35 U.S.C. §119 (*e*) of U.S. Provisional Application No. 60/702,996, filed Jul. 28, 2005.

FIELD OF THE INVENTION

The invention concerns a new soft magnetic composite material. Particularly, the invention concerns a process for the manufacturing of new soft magnetic composite materials having improved soft magnetic properties.

BACKGROUND OF THE INVENTION

Soft magnetic materials are used for applications, such as core materials in inductors, stators and rotors for electrical machines, actuators, sensors and transformer cores. Traditionally, soft magnetic cores, such as rotors and stators in electric machines, are made of stacked steel laminates.

However, in the last few years there has been a keen interest in so called Soft Magnetic Composite (SMC) materials. The SMC materials are based on soft magnetic particles, usually iron based, with an electrically insulating coating on each particle. By compacting the insulated particles, optionally together with lubricants and/or binders, using the traditionally powder metallurgy process, the SMC parts are obtained. By using the powder metallurgical technique it is possible to produce materials having a higher degree of freedom in the design of the SMC part compared to using steel laminates, as the SMC material can carry a three dimensional magnetic flux and as three dimensional shapes can be obtained with the compaction process.

As a consequence of the increased interest in the SMC materials, improvements of the soft magnetic characteristics of the SMC materials is the subject of intense studies in order to expand the utilisation of these materials. In order to achieve such improvement, new powders and processes are continuously being developed.

In addition to the soft magnetic properties, good mechanical properties are essential. In this respect steam treatment of the compacted composite body has shown promising results as disclosed in the U.S. Pat. No. 6,485,579. According to the present invention it has been found that steam treatment can give unexpectedly good results, not only as regards the mechanical properties, but also as regards the soft magnetic properties provided that certain conditions as regards the type of powders, lubricants, and process parameters are fulfilled. In brief and in contrast to the invention disclosed in the US patent it has been found that the lubricant used in the iron or iron-based composition to be compacted should be of organic nature and that it should vaporize without leaving any residues in the compacted body before the steam treatment.

SUMMARY OF THE INVENTION

The present invention concerns a process for the manufacture of soft magnetic composite components comprising the steps of:

- die compacting a powder composition comprising a mixture of soft magnetic, iron or iron-based powder, the core particles of which are surrounded by an electrically insulating, inorganic coating, and an organic lubricant in an amount of 0.05 to 1.5% by weight of the composition, said organic lubricant being free from metal and having a temperature of vaporisation less than the decomposition temperature of the coating;
- ejecting the compacted body from the die;
- heating the compacted body in a non reducing atmosphere to a temperature above the vaporisation temperature of the lubricant and below the decomposition temperature of the inorganic coating for removing the lubricant from the compacted body, and
- subjecting the obtained body to heat treatment at a temperature between 300° C. and 600° C. in water vapour.

According to the present invention powder metallurgically compacted bodies having superior mechanic and magnetic properties can be obtained. These bodies may be distinguished by superior properties such as a transverse rupture strength of at least 100 MPa, a permeability of at least 700 and a core loss at 1 Tesla and 400 Hz of at most 70 W/kg and more specifically a transverse rupture strength of at least 120 MPa, a permeability of at least 800 and a core loss at 1 Tesla and 400 Hz of at most 65 W/kg.

DETAILED DESCRIPTION OF THE INVENTION

The soft magnetic powders used according to the present invention are composed of iron or an alloy containing iron. Preferably the soft magnetic powder comprises essentially pure iron. This powder could be e.g. commercially available water-atomised or gas-atomised iron powders or reduced iron powders, such as sponge iron powders. Preferred electrically insulating layers, which may be used according to the invention, are thin phosphorous containing layers or barriers of the type described in the U.S. Pat. No. 6,348,265, which is hereby incorporated by reference. Other types of insulating layers are disclosed in e.g. the U.S. Pat. Nos. 6,562,458 and 6,419,877. Powders, which have insulated particles and which are suitable starting materials according to the present invention, are e.g. Somaloy® 500 and Somaloy® 700 available from Höganäs A B, Sweden.

So far very interesting results have been obtained with powders having coarse particles, such powders having mean particle sizes between 106 and 425 μm. More specifically at least 20% of the particles should preferably have a particle size above 212 μm.

The type of lubricant used in the iron or iron-based powder composition is important and is selected from organic lubricating substances that vaporize at temperatures above ambient temperature and below the decomposition temperature of the inorganic electrically insulating coating or layer without leaving any residues that are poisonous for the inorganic insulation, or that can block pores and thereby prevent subsequent oxidation according to the invention. Metal soaps, which are commonly used for die compaction of iron or iron based powders, leave metal oxide residues in the component and are therefore not suitable. The widely used zinc stearate for example, leaves zinc oxide, which has a detrimental effect on the insulating properties of e.g. phosphorous containing insulating layers. Impurities and traces of metal could of course be present in the lubricant used according to the invention.

Organic substances suitable as lubricating agents are fatty alcohols, fatty acids, derivates of fatty acids, and waxes. Examples of preferred fatty alcohols are stearyl alcohol, behenyl alcohol, and combinations thereof. Primary and secondary amides of saturated or unsaturated fatty acids may also be used e.g. stearamide, erucyl stearamide, and combinations thereof. The waxes are preferably chosen from polyalkylene waxes, such as ethylene bis-stearamide. Furthermore it is preferred that the lubricants are present in the composition to be compacted in particular form, although it may be that the lubricant may be present in other forms.

The amount of lubricant used may vary and is normally 0.05-1.5%, preferably 0.05-1.0%, more preferably 0.05-0.7 and most preferably 0.05-0.6% by weight of the composition to be compacted. An amount less than 0.05% of the lubricant gives poor lubricating performance, which may result in scratched surfaces of the ejected component and die wall, as well as lower electrical resistivity of the compacted component mainly due to deteriorated insulating layer at the component surface. In addition, components with scratched surfaces exhibit a higher degree of blocked surface pores, which in turn prevent the lubricant to vaporize freely.

Consequently, in the subsequent phase involving oxidation in steam (=water vapour), such poorly delubricated components will not easily allow the steam to penetrate and oxidize throughout the compacted body. Thus, low strength as well as poor electrical resistivity will be the result. The inorganic insulation and thus electrical resistivity of the body, will be better protected at high temperatures, if the steam and oxidation has penetrated throughout the body before it reaches the temperatures that can deteriorate the inorganic insulation. An amount more than 1.5% of the lubricant may improve the ejection properties but generally results in too low green density of the compacted component, thus, giving unacceptably low magnetic induction and magnetic permeability.

The compaction may be performed at ambient or elevated temperature. Thus, the powder and/or the die may be preheated before the compaction. So far the most interesting results have been obtained when the compaction is performed at elevated temperature obtained by heating the die to a controlled and predetermined temperature. Suitably the die temperature is adjusted to a temperature of at most 60° C. below the melting temperature of the used lubricating substance. For e.g. stearamide a preferred die temperature is 60-100° C., as stearamide melts at approximately 100° C.

The compaction is normally performed between 400 and 2000 MPa and preferably between 600 and 1300 MPa.

The compacted body is subsequently subjected to heat treatment in order to remove the lubricant at temperature above the vaporisation temperature of the lubricant but below the temperature of the decomposition temperature of the inorganic insulating coating/layer. For many presently used lubricants and insulating layers this means that the vaporisation temperature should be less than 500° C. and suitably between 200 and 450° C. Up to now the most interesting results have been obtained for lubricants having a vaporisation temperature less than 400° C. The method according to the present invention is however not particularly restricted to these temperatures but the temperatures to be used in the different steps are based on the relationship between the decomposition temperature of the electrically insulating layer and the vaporisation temperature of the lubricant.

The vaporization treatment shall preferably be conducted in an inert atmosphere, such as nitrogen. However, under certain conditions it may be interesting to vaporize the organic lubricant in an oxidizing atmosphere, such as air. In this case vaporization should be performed at a temperature below that, where significant surface oxidation of the iron or iron-based particles takes place in order to prevent blocking of surface pores, which may entrap non-vaporized lubricant or leave lubricant breakdown products inside the component. This means that the vaporisation temperature in e.g. air of lubricants used in connection with presently used phosphorus based inorganic coatings should be less than 400° C. and suitably between 200 and 350° C. Consequently, for lubricants with high vaporization temperatures (above about 350° C.), the delubrication must be performed in inert gas atmospheres in order to avoid pre-oxidation of the surface pores.

The delubricated body is subsequently steam treated at a temperature between 300° C. and 600° C. The treatment time normally varies between 5 and 120 minutes, preferably between 5 and 60 minutes. If the steam treatment is performed below 300° C., the time to gain sufficient strength may be unacceptably long. If, on the other hand, the steam treatment of the compacted body is kept at above about 600° C., the inorganic insulation may be destroyed. Thus the steam treatment time and temperature is suitably decided by the man skilled in the art in view of the desired strength, the type of lubricant and the type of electrical insulating coating.

The water vapour preferably used in the present invention can be defined as superheated steam with a partial pressure of one. An improved effect, i.e. shorter processing period or thicker oxide layers, would be expected if the superheated steam is pressurized. In order to achieve the best results concerning mechanical strength, magnetic properties and surface appearance of the compacted body care should be taken to ensure that the steam is not diluted or contaminated.

Without being bound to any specific theory it is believed that the steam treatment has a specific oxidizing effect on the surface of the iron-based particles. This oxidizing process is initiated at the surface of the compacted body and penetrates in towards the centre of the body. According to one embodiment of the invention the oxidizing process is terminated before the surfaces of all particles have been subjected to the specific oxidizing process. In this case an oxidized crust will surround an unoxidized core (see FIG. 1). Provided that the mechanical strength of the compacted body has reached an acceptable level the oxidation treatment can be terminated before complete oxidation throughout the compacted body has taken place. This suggests the possibility to optimise the mechanical strength and permeability relative to core loss. Oxidised material gives improved strength and permeability, but also slightly higher core losses.

The process may be performed batchwise or as a continuous process in furnaces that are commercially available from e.g. J B Furnace Engineering Ltd, SARNES Ingenieure OHG, Fluidtherm Technology P. Ltd, etc.

As can be seen from the following examples soft magnetic composite components having remarkable properties as regards the transverse rupture strength, electrical resistivity, magnetic induction, and magnetic permeability can be obtained by the method according to the invention.

EXAMPLES

Figure 1:
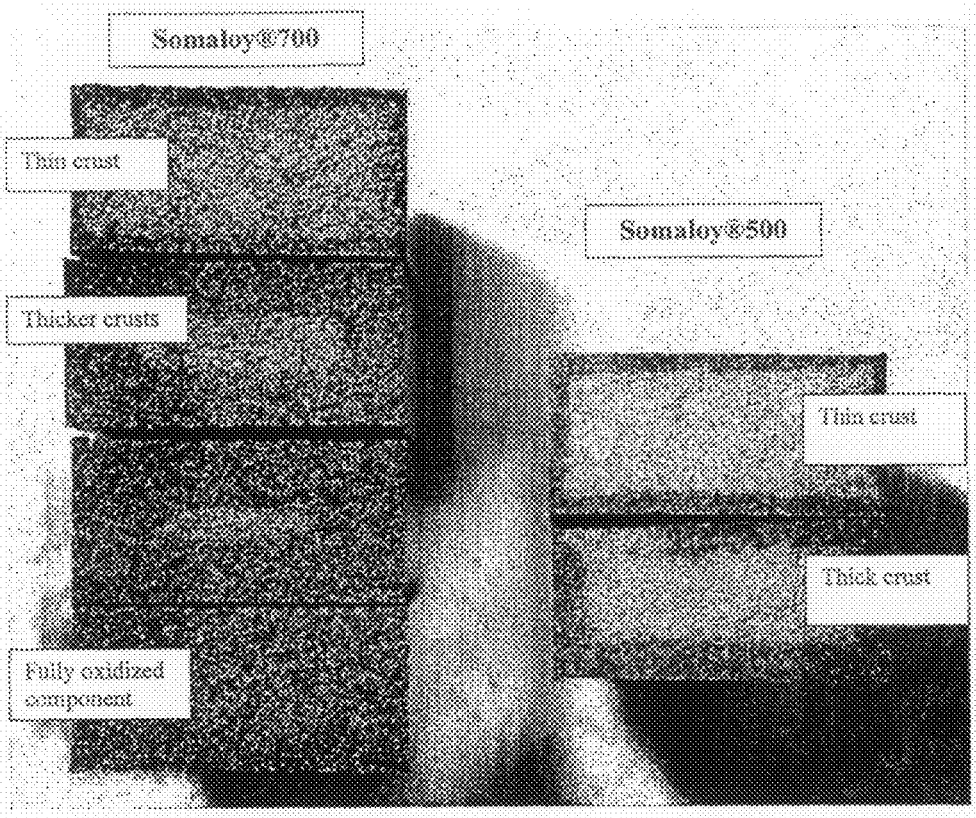
FIG. 1 shows different cross sections from different components produced according the present invention from Somaloy® 500 and Somaloy® 700, which are pure iron powders available from Höganäs A B, Sweden. The particles of these powders are insulated with a phosphorous containing layer. Fully oxidized components and components having an oxidized crust are shown in FIG. 1.

The invention is further illustrated by the following non-limiting examples;

Example 1

As starting material Somaloy® 700 was used. The starting material was mixed with different amounts (0.2-0.5 weight %) of an organic lubricant, stearamide, according to table 1.

The different formulations were compacted (600-1100 MPa) into toroid samples having an inner diameter of 45 mm, outer diameter 55 mm and height 5 mm and into Transverse Rupture Strength samples (TRS-samples) to the densities specified in table 1. The die temperature was controlled to a temperature of 80° C. and to ambient temperature (sample E).

After compaction the samples were ejected from the die and subjected to a heat treatment in an atmosphere of air for 20 minutes at 300° C. followed by steam treatment at 520° C. for 45 minutes. As a reference, a sample with 0.3% stearamide pressed at 800 MPa and subjected to a single step heat treatment in air at 520° C. for 30 minutes, was used.

Transverse Rupture Strength was measured on the TRS-samples according to ISO 3995. The magnetic properties were measured on toroid samples with 100 drive and 100 sense turns using a hysterisisgraph from Brockhaus. Maximum permeability at an applied electrical field of 4 kA/m was measured.

TABLE 1

| Sample | Stearamide [wt %] | Compaction Pressure [MPa] | Density [g/cm3] | TRS [MPa] | μmax |
|---|---|---|---|---|---|
| Reference | 0.30 | 800 | 7.54 | 45 | 620 |
| A | 0.30 | 600 | 7.44 | 115 | 800 |
| B | 0.30 | 800 | 7.56 | 130 | 860 |
| C | 0.30 | 1100 | 7.63 | 110 | 900 |
| D | 0.40 | 800 | 7.53 | 130 | 820 |
| E (ambient) | 0.40 | 800 | 7.49 | 135 | 750 |
| F | 0.20 | 1100 | 7.68 | 115 | 950 |
| G | 0.50 | 800 | 7.49 | 135 | 800 |

As can be seen from table 1, remarkably high TRS-values and high maximum permeability are obtained when the components (sample A to G) are steam treated according to the present invention as compared with the heat-treated reference component, which is only heat treated in air. Furthermore, using an unheated tool die gives lower density with slightly worse magnetic properties (sample E).

Example 2

Somaloy® 700 powder was mixed with 0.4 wt % stearamide and compacted at 800 MPa using a tool die temperature of 80° C. according to example 1 (density 7.53 g/cm3). The samples (D, H, and I) were further subjected to a heat treatment in an atmosphere of inert gas for 20 minutes at 300° C. followed by steam treatment at various temperatures, 300° C., 520° C. and 620° C., respectively.

The magnetic and mechanical properties were measured according to example 1. The specific electrical resistivity was measured on the toroid samples by a four point measuring method. The total core loss was measured at 1 Tesla and 400 Hz.

TABLE 2

| Sample | TRS [MPa] | Resistivity [μOhm*m] | μmax | Core loss [W/kg] |
|---|---|---|---|---|
| D (520° C. Steam) | 145 | 260 | 820 | 44 |
| H (300° C. Steam) | 110 | 860 | 630 | 68 |

TABLE 2-continued

| Sample | TRS [MPa] | Resistivity [μOhm*m] | μmax | Core loss [W/kg] |
|---|---|---|---|---|
| I (620° C. Steam) | 120 | 5 | 860 | 180 |

As can be seen from table 2, high TRS-values are obtained for a wide range of heat treatment temperatures in a steam (300° C. to 620° C.). However, low steam treatment temperatures provide less material relaxation, which results in higher core loss (sample H). A lower temperature (<300° C.) will result in no oxidizing effect or unacceptably long process times. In contrast, a too high temperature will deteriorate the insulating coating and give unacceptably low resistivity with poor magnetic properties such as core loss (sample I).

Example 3

Somaloy® 700 powder was mixed with 0.5 wt % of stearamide, EBS wax, and Zn-stearate, respectively, and compacted to 7.35 g/cm$^3$. The samples (J, K, and L) were further subjected to a heat treatment for 45 minutes in air at 350° C., and in an atmosphere of nitrogen at 440° C., respectively. The delubricated components were thereafter steam treated at 530° C. for 30 minutes.

The magnetic and mechanical properties were measured according to example 1 and 2 and summarised in table 3 below.

TABLE 3

| Sample | Vaporization Treatment | TRS [MPa] | Resistivity [μOhm*m] | μmax | Core Loss [W/kg] | Performance |
|---|---|---|---|---|---|---|
| J (Stearamide) | 350° C. Air | 141 | 165 | 620 | 58 | Good |
| | 440° C. $N_2$ | 150 | 67 | 620 | 63 | OK |
| K (EBS Wax*) | 350° C. Air | 69 | 11 | 350 | 100 | Poor |
| | 440° C. $N_2$ | 147 | 160 | 620 | 59 | Good |
| L (Zn-Stearate) | 350° C. Air | 122 | 8 | 680 | 90 | Poor |
| | 440° C. $N_2$ | 148 | 12 | 590 | 77 | Poor |

*Ethylene bis-stearamide (Acrawax ®)

As can be seen from table 3, the atmosphere and the temperature, at which the vaporization is conducted is of great importance. According to the invention, the lubricant should be vaporized and leave essentially no residue in order to obtain compacts which after the steam treatment have both high strength and high electrical resistivity.

Stearamide (sample J) is completely vaporized above 300° C. in both inert gas atmosphere and in air. The lowest possible vaporization temperature is preferred as this gives improved electrical resistivity and thus lower core loss. The EBS wax (sample K) cannot be vaporized at 350° C. in air but is removed from the compact in nitrogen at above 400° C. according to table 3.

From table 3 it can be seen that lubricants including a metal do not give satisfactory results, and that for different organic lubricants the type of atmosphere and temperature matters. For each lubricant/insulating layer combination suitable atmosphere and temperature can be decided by the man skilled in the art.

Example 4

Somaloy® 700 powder was mixed with 0.3 wt % of behenyl alcohol (NACOL® 22-98) and compacted at 800 MPa using a tool die temperature of 55° C. The samples (M, N, and O) were further subjected to a heat treatment in an atmosphere of inert gas for 30 minutes at various temperatures for vaporization of the lubricant according to table 4 and subsequently steam treated at 520° C. for 45 minutes.

TABLE 4

| Sample | Lubricant vaporization treatment | TRS [MPa] | Resistivity [μOhm*m] | Core loss [W/kg] |
|---|---|---|---|---|
| M | 250° C. | 65 | 12 | 101 |
| N | 350° C. | 149 | 153 | 54 |
| O | 450° C. | 154 | 52 | 74 |

The magnetic and mechanical properties were measured according to example 1 and 2.

Table 4 shows the importance to use a correct vaporization temperature of the lubricant. A too low vaporization temperature gives insufficient lubricant removal and closed surface pores (sample M). A too high vaporization temperature (sample O), conversely, will expose the insulating coating towards high temperature for unnecessary long periods with lower electrical resistivity as a result.

Example 5

Somaloy® 700 powder was mixed with 0.5 wt % of eight different lubricants and the samples were compacted at 800 MPa. The lubricants used were behenyl alcohol, stearamide, ethylene bis-stearamide (EBS), eurcyl-stearamide, oleic amide, polyethylene wax ($M_w$=655 g/mol; PW655), a polyamide (Orgasol® 3501), and zinc stearate.

Figure 2:
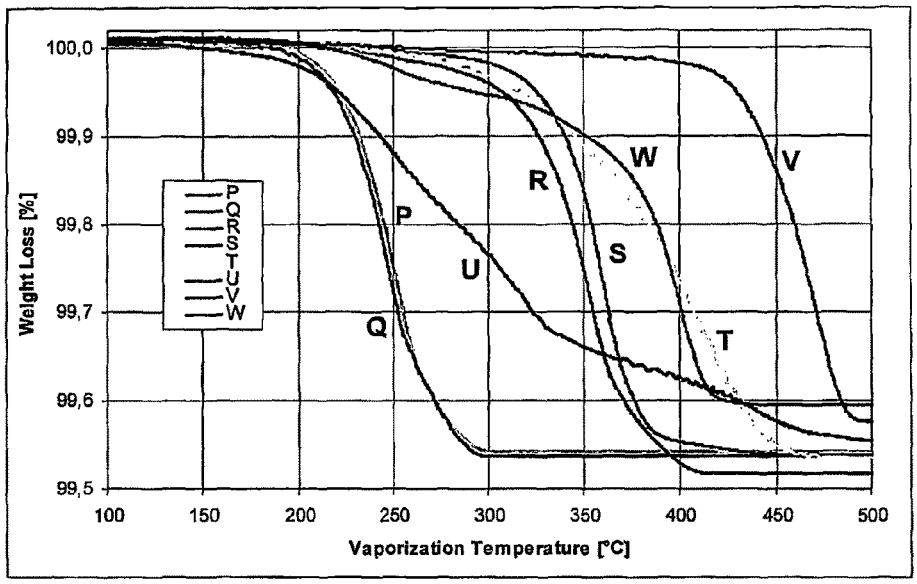
In FIG. 2, the thermogravimetric analysis of compacts with the different lubricants are shown.

A thermogravimetric analysis (TGA) of the samples (each sample weighing 0.68 g) was performed. The TGA measures the weight change in a material as function of temperature (or time) in a controlled atmosphere. The TGA curves were recorded between 20 and 500° C. using a heating rate of 10° C./min in an atmosphere of nitrogen and are disclosed in FIG. 2.

As can be seen the vaporization of lubricants proceeds differently for the lubricants.

Sample P, Q, R, and S contain lubricants having relatively low boiling points. These lubricants are removed primarily as vapours and leave compacts with a clean pore structure. The samples T, U, and V on the other hand, contain lubricants which vaporize at temperatures higher than 450° C., and are therefore not suitable to use in this case. The zinc stearate in sample W is completely vaporized below 450° C., but leaves residues of ZnO. Thus, sample W is outside the scope of the present invention.

Table 5 shows the temperature range for vaporization in inert atmospheres of the different lubricants according to the example. The samples P to S include lubricants which have vaporization temperatures suitable to use in combination with the powders tested.

TABLE 5

| Sample | Temperature of complete vaporization [° C.] | Oxidation Performance of heat treated compact |
|---|---|---|
| P (Behenyl alcohol) | 290-300 | Good |
| Q (Stearamide) | 290-300 | Good |
| R (Eurcyl-Stearamide) | 410-420 | Good |
| S (EBS) | 390-440 | Good |
| T (PW655) | 470-500 | Poor |
| U (Oleic amide) | >500 | Poor |
| V (Polyamide) | >550 | Poor |
| W (Zn-Stearate) | Not possible | Poor |

Example 6

Somaloy® 700 powder was mixed with 0.5 wt % of a metal-organic lubricant according to table 6, and compacted at 800 MPa using a tool die temperature of 80° C. The samples were further subjected to a heat treatment in air for 20 minutes at 300° C. followed by steam treatment at 520° C. for 45 minutes.

The magnetic and mechanical properties were measured according to example 1 and 2 and are summarized in the following table 6.

TABLE 6

| Sample | Density [g/cm3] | TRS [MPa] | Resistivity [μOhm*m] | Core loss [W/kg] |
|---|---|---|---|---|
| G (Stearamide) | 7.49 | 135 | 192 | 45 |
| X (Kenolube ®) | 7.47 | 105 | 90 | 51 |
| Y (Li-stearate) | 7.50 | 90 | 20 | 63 |
| Z (Zn-stearate) | 7.52 | 100 | 4 | 126 |

As can be seen from table 6, lubricants having different contents of metal (Samples X, Y, Z), give lower electrical resistivity and thus higher core loss than Sample G, which is prepared with stearamide.

Example 7

Somaloy® 700 powder was mixed with 0.5 wt % of EBS wax (Acrawax®) and compacted to 7.35 g/cm$^3$. One sample (AA) was first subjected to a heat treatment for 45 minutes in an atmosphere of nitrogen at 440° C. according to the invention. A second sample (AB) was not previously de-lubricated but directly subjected to steam treatment according to the method disclosed in the U.S. Pat. No. 6,485,579. The steam treatment of the samples was conducted at a maximum temperature of 500° C. for 30 minutes.

The magnetic and mechanical properties were measured according to example 1 and 2.

TABLE 7

| Sample | Vaporization Treatment | TRS [MPa] | Resistivity [μOhm*m] | μmax | Core loss [W/kg] | Performance |
|---|---|---|---|---|---|---|
| AA (EBS wax) | 440° C. $N_2$ | 138 | 85 | 600 | 61 | OK |
| AB* (EBS Wax) | None | 65 | 17 | 350 | 98 | Poor |

*according to the description U.S. Pat. No. 6 485 579.

As can be observed in table 7, the high mechanical strength and superior electrical resistivity of sample AA shows that delubrication prior to steam treatment according to the invention gives the superior properties, whereas sample AB shows comparatively low resistivity and low mechanical strength. For the lubricant used (a non-metal containing lubricant, in this example EBS wax), the success of steam treatment depends on the delubrication step.

Example 8

In this example, Somaloy® 500 powder (available from Höganäs A B Sweden) with mean particle size smaller than the mean particle size of Somaloy® 700 was used. Somaloy® 500 was mixed with 0.5 wt % of stearamide or Kenolube® and compacted at 800 MPa using a tool die temperature of 80° C. Two samples (AC and AD) were further subjected to a heat treatment in inert gas for 20 minutes at 300° C. followed by steam treatment at 520° C. for 45 minutes according to the invention.

The magnetic and mechanical properties were measured according to example 1.

TABLE 8

| Sample | Density [g/cm3] | TRS [MPa] | Resistivity [μOhm*m] | μmax | Core loss [W/kg] |
|---|---|---|---|---|---|
| AC (Stearamide) | 7.36 | 150 | 30 | 450 | 65 |
| AD* (Kenolube ®) | 7.36 | 120 | 5 | 420 | 105 |

*according to the description of U.S. Pat. No. 6 485 579

Table 8 clearly shows that components manufactured according to the invention from the finer Somaloy® 500 powder with a non metal-containing lubricant (sample AC) can reach high strength and acceptable core losses. It is clear that sample AC exhibits better values for TRS, resistivity, permeability, as well as core loss compared to sample AD.

The invention claimed is:

1. A process for the manufacture of soft magnetic composite components comprising the steps of:

die compacting a powder composition comprising a mixture of soft magnetic, iron or iron-based powder, core particles of which are surrounded by an electrically insulating, inorganic coating, and an organic lubricant in an amount of 0.05 to 1.5% by weight of the composition, said organic lubricant being free from metal and having a temperature of vaporisation less than the decomposition temperature of the coating;

ejecting the compacted body from the die;

heating the compacted body in an inert atmosphere to a temperature above the vaporisation temperature of the lubricant and below the decomposition temperature of the inorganic coating for removing the lubricant from the compacted body, and subjecting the body obtained after heating the compacted body in an inert atmosphere to heat treatment at a temperature between 300° C. and 600° C. in water vapour.

2. A process according to claim 1, wherein the compaction is performed at elevated temperature.

3. A process according to claim 2, wherein the compaction is performed at a temperature of at most 60° C. below the melting temperature of the organic lubricant.

4. A process according to claim 1, wherein the temperature of vaporization of the lubricant is less than 500° C.

5. A process according to claim 1, wherein the treatment in water vapour (steam treatment) is performed at a temperature less than 550° C.

6. A process according to claim 1, wherein the core particles consist of essentially pure iron.

7. A process according to claim 1, wherein the inorganic coating insulating the core particles includes phosphorus.

8. A process according to claim 1, wherein the mean particle size of the insulated powder particles is between 106 and 425 μm.

9. A process according to claim 1, wherein at least 20% of the insulated powder particles have a particle size above 212 μm.

10. A process according to claim 1, wherein the amount of lubricant is 0.05-1.0% by weight of the composition.

11. A process for the manufacture of soft magnetic composite components comprising the steps of:

die compacting a powder composition comprising a mixture of soft magnetic, iron or iron-based powder, core particles of which are surrounded by an electrically insulating, inorganic coating, and an organic lubricant in an amount of 0.05 to 1.5% by weight of the composition, said organic lubricant being free from metal and having a temperature of vaporisation less than the decomposition temperature of the coating;

ejecting the compacted body from the die;

heating the compacted body in a non reducing atmosphere to a temperature above the vaporisation temperature of the lubricant and below the decomposition temperature of the inorganic coating for removing the lubricant from the compacted body, and subjecting the body obtained after heating the compacted body in a non reducing atmosphere to heat treatment at a temperature between 300° C. and 600° C. in water vapour, wherein the lubricant is selected from the group consisting of primary amides and secondary amides of saturated or unsaturated fatty acids or combinations thereof, wherein the lubricant has a temperature of vaporization in air of between 200 to 350° C.

12. A process for the manufacture of soft magnetic composite components comprising the steps of:

die compacting a powder composition comprising a mixture of soft magnetic, iron or iron-based powder, core particles of which are surrounded by an electrically insulating, inorganic coating, and an organic lubricant in an amount of 0.05 to 1.5% by weight of the composition, said organic lubricant being free from metal and having a temperature of vaporisation less than the decomposition temperature of the coating;

ejecting the compacted body from the die;

heating the compacted body in a non reducing atmosphere to a temperature above the vaporisation temperature of the lubricant and below the decomposition temperature of the inorganic coating for removing the lubricant from the compacted body, and subjecting the body obtained after heating the compacted body in a non reducing atmosphere to heat treatment at a temperature between 300° C. and 600° C. in water vapour, wherein the lubricant is selected from the group consisting of saturated or unsaturated fatty alcohols, wherein the lubricant has a temperature of vaporization in air of between 200 to 350° C.

13. A process according to claim 1, wherein the lubricant is selected from the group consisting of stearamide, erucylstearamide and behenyl alcohol.

14. A process according to claim 1, wherein the lubricant is an amide wax.

15. A soft magnetic composite component prepared according to claim 1 having an oxidized crust and an unoxidized core.

16. A soft magnetic composite component having a transverse rupture strength of at least 120 MPa, a permeability of at least 700 and a core loss at 1 Tesla and 400 Hz of at most 70 W/kg.

17. A soft magnetic composite component having a transverse rupture strength of at least 120 MPa, a permeability of at least 800 and a core loss at 1 Tesla and 400 Hz of at most 65 W/kg.

18. A process according to claim 1 wherein the lubricant is ethylene-bisstearamide.

19. A process according to claim 1 wherein the inert atmosphere is nitrogen.

20. A process according to claim 1 wherein the process is adapted to produce a soft magnetic composite component having a transverse rupture strength of at least 120 MPa, a permeability of at least 700 and a core loss at 1 Tesla and 400 Hz of at most 70 W/kg.

* * * * *